US006309091B1

(12) United States Patent
Weissman

(10) Patent No.: US 6,309,091 B1
(45) Date of Patent: Oct. 30, 2001

(54) LAMP SHADE ASSEMBLY

(76) Inventor: William Weissman, P.O. Box 143, Lake Hill, NY (US) 12448

( * ) Notice: Subject to any disclaimer, the term of this patent is extended or adjusted under 35 U.S.C. 154(b) by 0 days.

(21) Appl. No.: 09/514,127

(22) Filed: Feb. 28, 2000

(51) Int. Cl.[7] ..... F21V 11/02

(52) U.S. Cl. ..... 362/354; 362/279; 362/320; 362/414

(58) Field of Search ..... 362/278, 279, 362/290, 320, 354, 414

(56) References Cited

U.S. PATENT DOCUMENTS

| | | | | |
|---|---|---|---|---|
| 2,230,186 | | 1/1941 | Johns et al. . | |
| 2,435,786 | * | 2/1948 | Klosek | 362/354 |
| 2,437,825 | | 3/1948 | Kohn . | |
| 2,625,648 | | 1/1953 | Zenda . | |
| 2,670,431 | | 2/1954 | Bullock . | |
| 2,771,544 | | 11/1956 | Lipscomb . | |
| 4,998,192 | * | 3/1991 | Arndt | 362/376 |
| 5,276,601 | | 1/1994 | Holzhacker . | |

* cited by examiner

*Primary Examiner*—Sandra O'Shea
*Assistant Examiner*—John Anthony Ward

(57) ABSTRACT

A lamp shade together with a lamp base and light source which includes one or more flexible and stretchable translucent annular sheets with large and small ring elements on the edge portions of each sheet, one ring element of each pair being fixed to the lamp base and the other being movable so that the associated annular sheet can be located in a selected position in relation to the light source.

10 Claims, 5 Drawing Sheets

LAMP SHADE ASSEMBLY

BACKGROUND OF THE INVENTION

Lamp shades have often been designed in louvered form to control the amount and direction of light passing out of the shade. Adjustable lamp shades of that general class are shown in U.S. Pat. Nos. 5,276,601, 2,670,431, 2,437,825 and 2,230,186. In all such designs a plurality of louvers or shutters are employed in a given typically circular annulus around a central light source of the lamp, and the louvers or shutters are each of rigid form. Collapsible lamp shades are also well known as in U.S. Pat. Nos. 2,771,544 and 2,625,648 where telescoping rings of rigid material can drop into position around the light source.

In none of these prior art lamp shade designs does a translucent flexible and stretchable annular sheet surround the light source. It is a principal purpose of the present invention to provide just such a translucent shade around the light source, one that is flexible and stretchable and which is positioned around the light source to give the desired effect on the amount and direction of emitted light.

SUMMARY OF THE INVENTION

A lamp shade is provided by the invention in combination with a lamp base and a light source. The shade, base and light source are all on a common axis. Surrounding that axis is a pair of first and second ring elements of large and small diameter respectively. One of the ring elements of the pair is fixed and the other is axially movable in relation to the lamp base. A flexible and stretchable translucent annular sheet is included having an outer edge portion secured to the first ring element and an inner edge portion secured to the second ring element. By this structure the movable ring element is displaceable along the axis to establish a selected position of the flexible annular sheet in relation to light from the light source.

In a preferred form the ring elements are circular and the annular sheet is of stretchable polyester fabric.

There may be a plurality of pairs of first and second ring elements each with its annular sheet therebetween spaced along the common axis around and above and below the light source. The large diameter ring element of each pair may be fixed with respect to the lamp base and the small diameter ring element may be axially movable. A linkage may connect all of the small diameter ring elements of the pairs to permit all of the small diameter ring elements to be moved equally together in relation to the lamp base.

Alternatively there may be a single pair of first and second ring elements with the flexible annular sheet therebetween. The small diameter ring of that single pair may be fixed with respect to the lamp base and the large diameter ring element may be axially movable. The large diameter ring element then hangs freely by the flexible annular sheet from the small diameter ring element.

DESCRIPTION OF PREFERRED EMBODIMENTS

Figure 1:
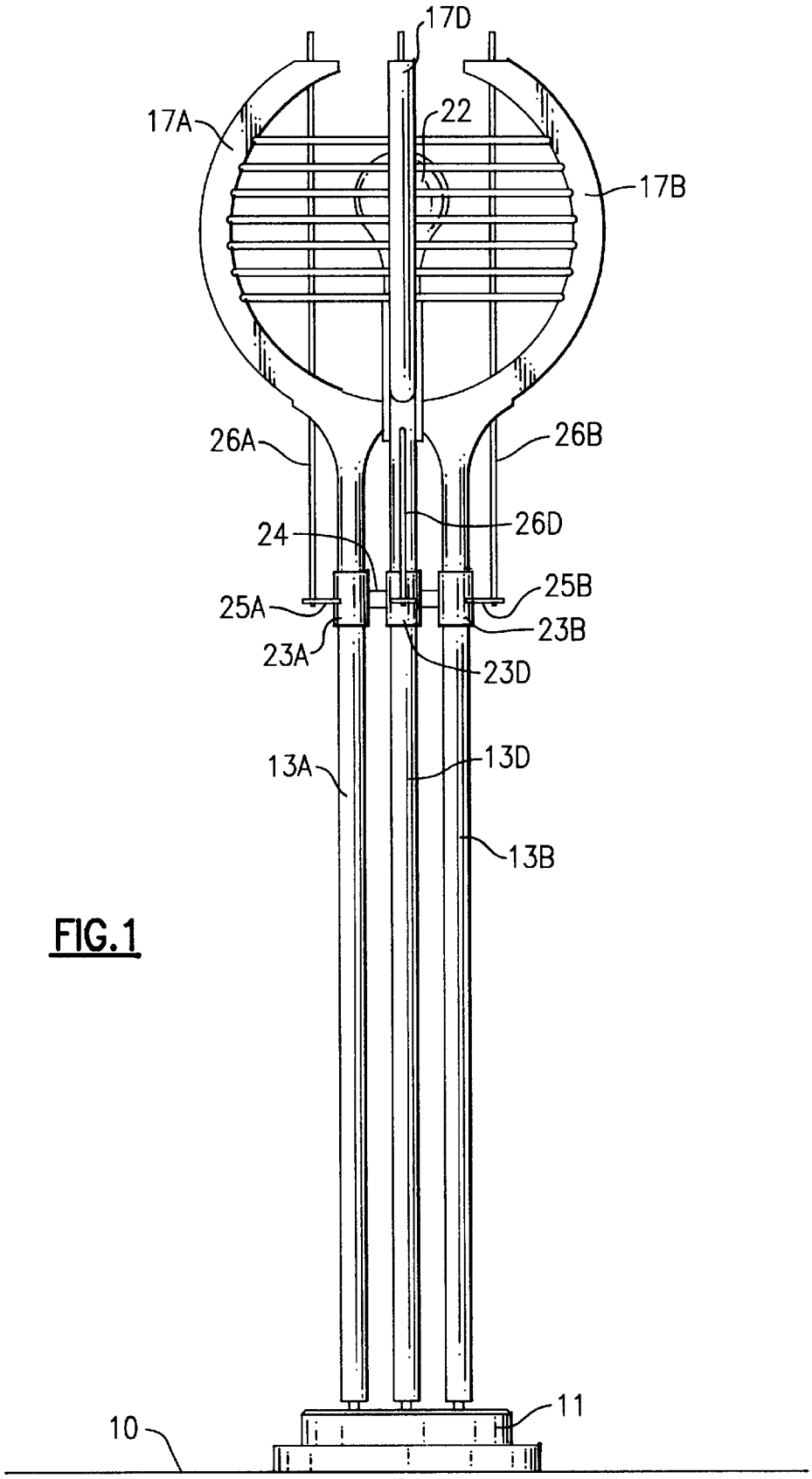
FIG. 1 is an overall elevation of a preferred form of the lamp of the invention including a plurality of flexible and stretchable annular sheets around the light source.

Referring first to FIG. 1 a floor lamp version of a lamp fitted with the shade of the invention is shown standing on a floor surface 10. The lamp includes a standard 11 on which four elongated rods 13A to 13D are mounted parallel to one another and spaced equidistantly around the vertical centerline of the lamp. All of the rods 13A to 13D are of circular cross section and of the same length and diameter. The material of the standard 11 and rods 13A to 13D is a matter of choice but some form of wood or aluminum is preferred.

Figure 2:
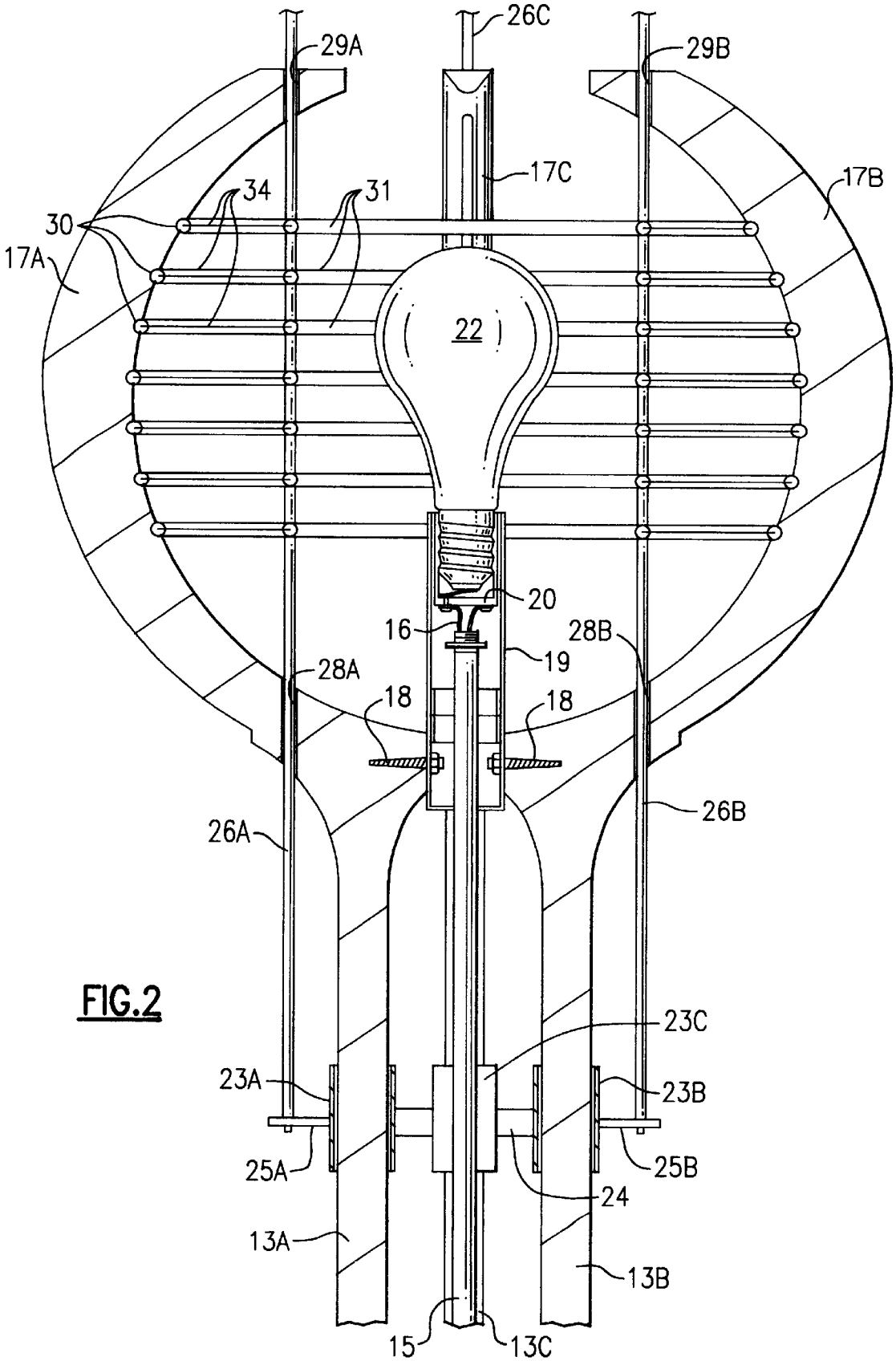
FIG. 2 is an enlarged fragmentary elevation partly in section of the upper portion of the lamp of FIG. 1 with the annular sheets in horizontal position.

The vertical section in FIG. 2 of the upper portion of the lamp shows that a central tubular member 15 extends upwardly along the axis of the lamp with the four rods 13A to 13D spaced around it. An electrical cord 16 for the lamp is disposed within the tubular member 15 and continues out in a conventional manner not shown in the drawings through the standard 11 of the lamp with the usual male electrical connector at its outer end.

In the FIG. 2 vertical section the rods opposite one another on the left and right in the drawing are rods 13A and 13B. All of the rods 13A to 13D fair at their upper ends into decorative inwardly facing crescents two of which on the left and right are marked 17A and 17B respectively. Only an upper section of the rear crescent 17C in the middle is visible in FIG. 2. Each of these four crescents faces toward the axis of the lamp and all are interconnected at their lower ends by screws 18 and by a cylindrical body 19 in which the upper end of the central tubular member 15 is disposed. It will be seen that in FIG. 1 the front middle crescent 17D is also visible. In the tubular member 15 is a conventional bulb socket 20 to which wires of the electrical cord 16 are connected. A light bulb 22 is screwed into the socket 20.

Slideably movable up and down on an upper end portion of the rods 13A to 13D are associated bushings 23A to 23D all four of which are interconnected by a spoke element 24. Referring to FIG. 2 bushings 23A and 23B fit snugly about the rods 13A and 13B on the left and right and an additional bushing 23C fits snugly about the rear rod 13C. Extending rigidly from each bushing in a radially outward direction is an arm and such arms 25A and 25B associated with the bushings 23A and 23B respectively are shown in FIG. 2. At the outer end of each arm is attached a lower end of an elongated shaft, and again in FIG. 2 shafts 26A and 26B are shown. Just the upper end portion of the similar shaft 26C is also visible in its rear position in FIG. 2. In FIG. 1 the front shaft 26D associated with the crescent 17D is also visible together with its bushing 23D. As shown in FIG. 2 the shaft 26A extends in slideable relation through two holes 28A and 29A in the crescent 17A and in similar fashion the shaft 26B extends slideably through holes 28B and 29B in the crescent 17B. The shafts 26A to 26D are movable together up and down in their associated crescents 17A to 17D. Some of the ring elements are above the bulb 22, some are below and some are generally at the same level.

The term lamp base is used herein in reference to the standard 11 and the four rods 13A to 13D with their crescents 17A to 17D. The lamp shade of the invention used with this lamp base will now be described with reference to FIGS. 2 to 4. It includes seven pairs of first and second or outer and inner rigid ring elements encircling the vertical axis of the lamp each of self-supporting shape. The first outer ring elements are designated by the reference numeral 30 and they are affixed at levels equally spaced from one another on the inside surface of the crescents 17A to 17D by mechanical fasteners or bushings. They are of different overall diameters because of the curved shape of the crescents. The second inner ring element of each pair is designated by the reference numeral 31 and they are affixed equally apart from one another to the four vertically movable shafts 26A to 26D. The second inner ring elements are all of the same diameter and in every case smaller than the first outer ring elements 30. They are axially movable up and down in relation to the lamp base by displacement of the shafts 26A to 26D.

Joining the pairs of ring elements 30 and 31 are respective flexible and stretchable translucent annular sheets 34 each having an outer edge portion secured to the associated large outer ring element 30 and an inner edge portion secured to the associated small inner ring element 31. The sheets 34 are preferably of stretchable polyester fabric.

Figure 3:
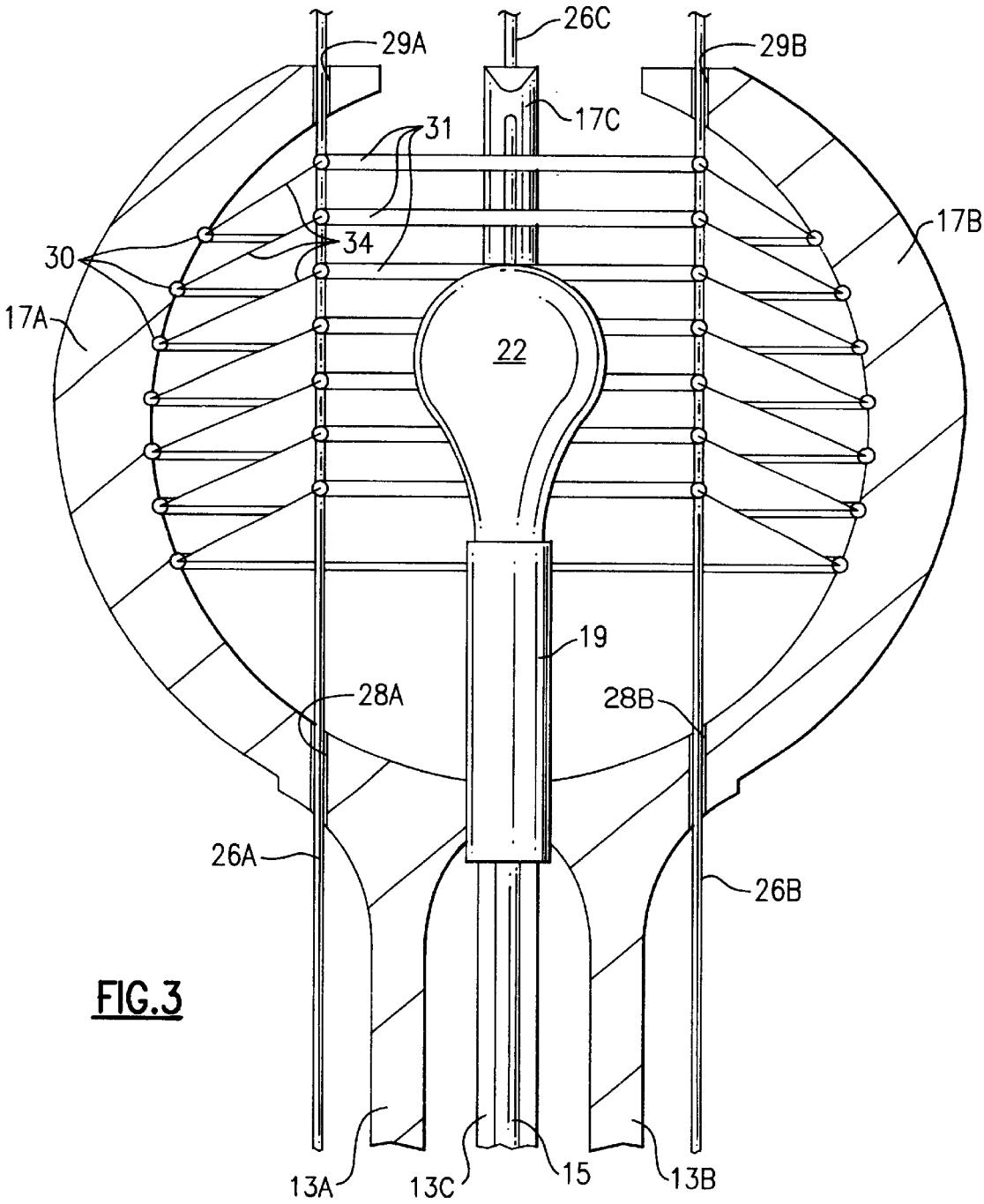
FIG. 3 is a further enlarged fragmentary view similar to FIG. 2 showing the inner edge portions of the annular sheets raised above the outer edge portions.
Figure 4:
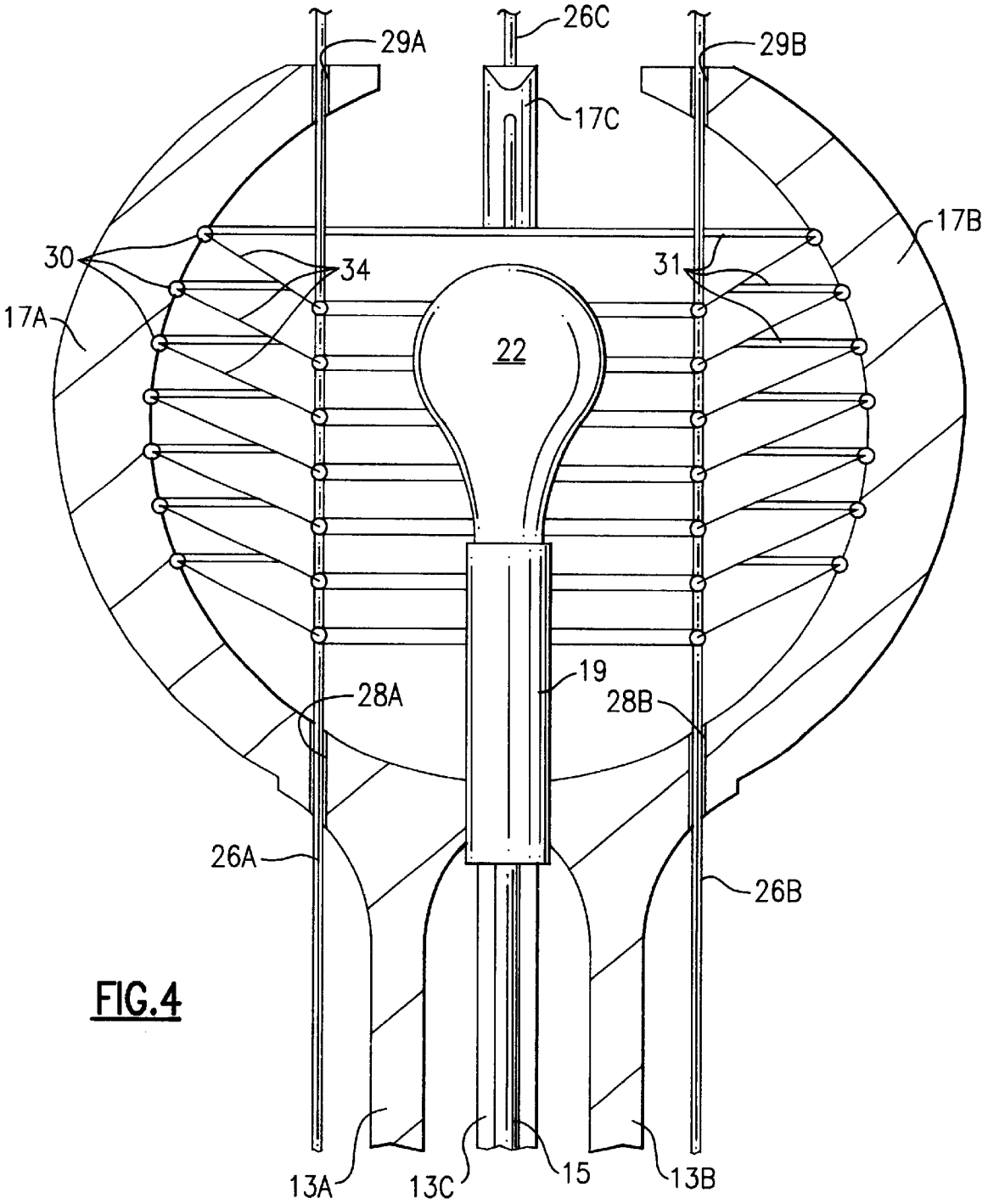
FIG. 4 is a view similar to FIG. 3 showing the inner edge portions of the annular sheets lowered below the outer edge portions.

It will be seen that the shafts 26A to 26D function as linkages connecting all of the small diameter ring elements 31 to permit all of them to be moved together up and down in relation to the lamp base. In FIG. 2 the inner ring elements 31 are all at the same level as their associated outer ring elements 30 fixed in relation to the lamp base. FIG. 3 shows the inner ring elements 31 raised an equal amount above their associated outer ring elements 30. In FIG. 4 the inner ring elements 31 are all at a level below their associated outer ring elements 30. This movement up and down of the outer ring elements 31 is accomplished simply by sliding the four bushings 23A to 23D up and down together on their associated rods 13. Any suitable means may be provided to hold the bushings 23A to 23D in a given position.

Figure 5:
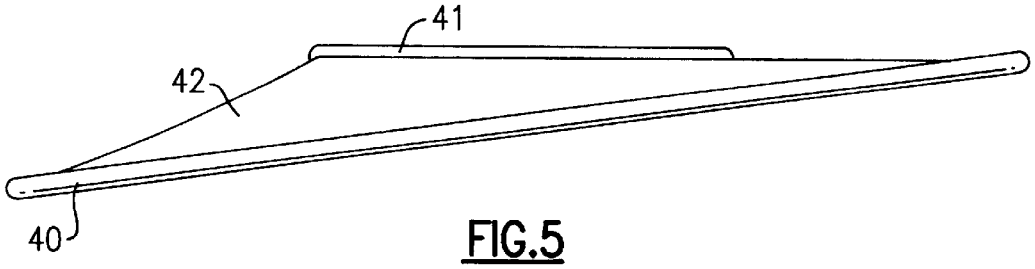
FIG. 5 is an enlarged side elevation of one pair of the ring elements and their annular sheet with one side of the larger ring element lowered and the opposite side of that larger ring element neither raised nor lowered.

In FIG. 5 one of the several ring element pairs with its associated translucent sheet is shown. The pair consists of a rigid outer ring element 40 and a rigid inner ring element 41 with its interconnecting annular sheet 42, all as described previously. The ring element pair of FIG. 5 is to be used with bushings 23A and 23B which are not interconnected and which are therefore movable with respect to one another, unlike in the embodiment of FIGS. 1 to 4. When that is so the bushing 23A, for example, can be moved down similar to the position shown in FIG. 4 while the bushing 23B is held stationary similar to the position shown in FIG. 2. This would result in the condition shown in FIG. 5 in which the rigid outer ring 40 is lowered on one side and the rigid inner ring 41 is held level, so that light emitted to the left as shown in FIG. 5 is directed downwardly and light emitted to the right is emitted straight out. By moving the bushings independently in this fashion light may be directed downwardly or upwardly or straight out from any quadrant of the pair of ring elements 40 and 41 associated annular sheet 42.

Figure 6:
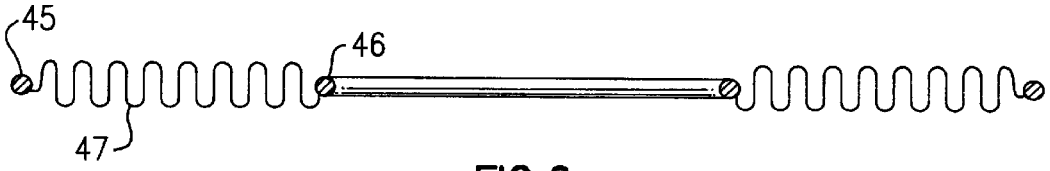
FIG. 6 is a side section of a form where only a single pair of ring elements is provided showing the two ring elements of the pair in a pre-installation condition with both rings in one plane.
Figure 7:
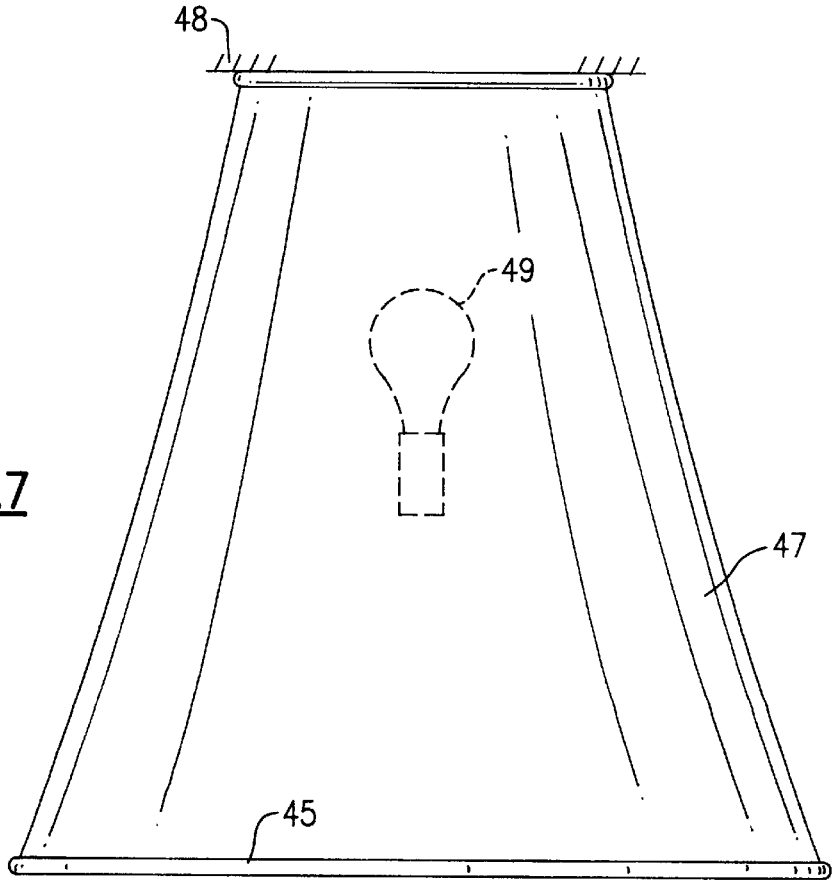
FIG. 7 is a side elevation of the embodiment of FIG. 6 with the large ring element in operational position hanging by the annular sheet from the fixed small ring element.

FIGS. 6 and 7 illustrate an embodiment of the invention different from that of FIGS. 1 to 5. Here only a single pair of large first and small second circular rings 45 and 46 respectively are utilized. They are connected by a flexible and stretchable translucent annular sheet 47 which is of a much greater dimension between the rings than in the embodiment of FIGS. 1 to 5. Also it is the small ring 46 which is fixed in relation to the lamp base shown schematically in FIG. 7 by the reference numeral 48. The large ring 45 then hangs freely by the annular sheet 47 from the small ring 46 as shown in FIG. 7. By this construction the annular sheet 47 is established in a selected position in relation to light from a light bulb 49 of the lamp.

The scope of the invention is to be determined by the following claims rather than the foregoing description of preferred embodiments.

What is claimed is:

1. A lamp shade in combination with a lamp base and light source all on a common axis comprising a) a pair of first and second ring elements of large and small diameter respectively surrounding said axis, b) one of the ring elements of the pair being fixed and the other being axially movable in relation to the lamp base, c) a flexible and stretchable translucent annular sheet having an outer edge portion secured to the first ring element and an inner edge portion secured to the second ring element, d) whereby the movable ring element is displaceable along said axis to establish a selected position of the flexible annular sheet in relation to light from the light source.

2. A lamp shade according to claim 1 wherein the ring elements are circular and the annular sheet is of stretchable polyester fabric.

3. A lamp shade according to claim 1 which comprises a plurality of said pairs of first and second ring elements each with its annular sheet therebetween spaced along said common axis around and above and below said light source.

4. A lamp according to claim 3 wherein the large diameter ring element of each pair is fixed with respect to the lamp base and the small diameter ring element is axially movable.

5. A lamp shade according to claim 4 wherein a linkage connects all of the small diameter ring elements of the pairs to permit all of the small diameter ring elements to be moved equally together in relation to the lamp base.

6. A lamp shade in combination with a lamp base and light source all on a common axis comprising a) a plurality of pairs of first and second circular ring elements of large and small diameter respectively encircling said axis around and above and below said light source, b) the large ring element of each pair being fixed and the small ring element of each pair being axially movable in relation to the lamp base, c) flexible and stretchable translucent annular sheets each having an outer edge portion secured to the large ring element of a given pair and an inner edge portion secured to the small ring element of that pair, and d) a linkage connecting all of the small diameter ring elements of the pairs to permit all of the small diameter ring elements to be moved equally together in relation to the lamp base, f) whereby the movable small ring element of each pair is displaceable along said axis to establish selected positions of the flexible annular sheets in relation to light from the light source.

7. A shade according to claim 1 which comprises a single pair of first and second ring elements with said flexible annular sheet therebetween.

8. A lamp shade according to claim 7 wherein the small diameter ring element of the pair is fixed with respect to the lamp base and the large diameter ring element is axially movable.

9. A lamp shade according to claim 8 wherein the large diameter ring element hangs freely by the flexible annular sheet from the small diameter ring element.

10. A lamp shade in combination with a lamp base and light source all on a common axis comprising a) a single pair of first and second circular ring elements of large and small diameter respectively encircling said axis, b) the small ring element of the pair being fixed and the large diameter ring element being axially movable in relation to the lamp base, and c) a flexible and stretchable translucent annular sheet having an outer edge portion secured to the large ring element and an inner edge portion secured to the small ring element, d) the large ring element hanging freely by the flexible annular sheet from the small ring element, e) whereby the flexible annular sheet is established in a selected position in relation to light from the light source.

* * * * *